US012203172B2

(12) United States Patent
Angenendt et al.

(10) Patent No.: US 12,203,172 B2
(45) Date of Patent: Jan. 21, 2025

(54) AQUEOUS DISPERSION FOR ACTIVATING A METAL SURFACE AND METHOD FOR THE PHOSPHATING THEREOF

(71) Applicant: Henkel AG & Co. KGaA, Duesseldorf (DE)

(72) Inventors: Christina Angenendt, Straelen (DE); Jan-Willern Brouwer, Willich (DE); Hendrik Bussmann, Hamburg (DE); Franz-Adolf Czika, Neuss (DE); Ralf Posner, Dormagen (DE); Sebastian Sinnwell, Duesseldorf (DE); Kristof Wapner, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 916 days.

(21) Appl. No.: 17/106,337

(22) Filed: Nov. 30, 2020

(65) Prior Publication Data

US 2021/0087693 A1 Mar. 25, 2021

Related U.S. Application Data

(63) Continuation of application No. PCT/EP2019/065005, filed on Jun. 7, 2019.

(30) Foreign Application Priority Data

Jun. 11, 2018 (EP) ..... 18176991

(51) Int. Cl.
*C23C 22/12* (2006.01)
*C23C 22/78* (2006.01)
*C23F 11/10* (2006.01)

(52) U.S. Cl.
CPC ..... *C23C 22/12* (2013.01); *C23C 22/78* (2013.01); *C23F 11/10* (2013.01)

(58) Field of Classification Search
CPC ..... C23C 22/12
See application file for complete search history.

(56) References Cited

U.S. PATENT DOCUMENTS

| | | | |
|---|---|---|---|
| 6,478,860 | B1 | 11/2002 | Nakayama et al. |
| 6,723,178 | B1 | 4/2004 | Bannai |
| 2006/0113005 | A1 | 6/2006 | Ando et al. |
| 2014/0272405 | A1 | 9/2014 | Okerberg et al. |
| 2015/0064445 | A1 | 3/2015 | McMillen et al. |

FOREIGN PATENT DOCUMENTS

| | | | |
|---|---|---|---|
| CN | 1657652 | A | 8/2005 |
| CN | 105518181 | A | 4/2016 |
| DE | 10241853 | B3 | 1/2004 |
| DE | 202008008419 | U1 | 7/2009 |
| EP | 1378586 | A1 | 1/2004 |
| EP | 1566465 | A1 | 8/2005 |
| EP | 1566466 | A1 | 8/2005 |
| EP | 1815974 | A1 | 8/2007 |
| EP | 1930473 | A1 | 6/2008 |
| EP | 1930474 | A1 | 6/2008 |
| EP | 1930475 | A1 | 6/2008 |
| EP | 1959031 | A1 | 8/2008 |
| EP | 1992719 | A1 | 11/2008 |
| EP | 2007920 | B1 | 10/2013 |
| EP | 2956569 | B1 | 4/2017 |
| EP | 2007921 | B1 | 6/2017 |
| EP | 2376674 | B1 | 3/2018 |
| JP | H05050029 | A | 8/1991 |
| JP | 2005306905 | A | 11/2005 |
| JP | 2006001960 | A | 1/2006 |
| JP | 2010030836 | A | 2/2010 |
| JP | 2010116588 | A | 5/2010 |
| JP | 2017170305 | A | 9/2017 |
| WO | 9839498 | A1 | 9/1998 |
| WO | 0005066 | A1 | 2/2000 |
| WO | 0112341 | A1 | 2/2001 |
| WO | 02061176 | A1 | 8/2002 |
| WO | 2015158794 | A1 | 10/2015 |
| WO | 2017017036 | A1 | 2/2017 |

OTHER PUBLICATIONS

International Search Report issued in connection with International Patent Application No. PCT/EP2019/065005 mailed on Jul. 24, 2019.

Written Opinion issued in connection with International Patent Application No. PCT/EP2019/065005 mailed on Jul. 24, 2019.

*Primary Examiner* — Peter F Godenschwager
(74) *Attorney, Agent, or Firm* — Mary K. Cameron

(57) ABSTRACT

The present invention relates to an aqueous dispersion as a concentrate for the activation stage of phosphating of metal surfaces, containing a dispersed particulate constituent and a thickener, the particulate constituent containing, in addition to dispersed inorganic compounds of polyvalent metal cations, polymeric organic compounds as dispersing agents which are composed at least partially of styrene and/or an α-olefin having no more than 5 carbon atoms and maleic acid, its anhydride and/or its imide, and which additionally comprise polyoxyalkylene units. The aqueous dispersion is further characterized by a D50 value above 10 μm. The present invention also relates to a method for anti-corrosion pretreatment of the surfaces of a metal material, in particular for zinc phosphating.

16 Claims, No Drawings

AQUEOUS DISPERSION FOR ACTIVATING A METAL SURFACE AND METHOD FOR THE PHOSPHATING THEREOF

The present invention relates to an aqueous dispersion as a concentrate for the activation stage of phosphating of metal surfaces, containing a dispersed particulate constituent and a thickener, the particulate constituent containing, in addition to dispersed inorganic compounds of polyvalent metal cations, polymeric organic compounds as dispersing agents which are composed at least partially of styrene and/or an α-olefin having no more than 5 carbon atoms and maleic acid, its anhydride and/or its imide, and which additionally comprise polyoxyalkylene units. The aqueous dispersion is further characterized by a D50 value above 10 μm. The present invention also relates to a method for anti-corrosion pretreatment of the surfaces of a metal material, in particular for zinc phosphating.

Layer-forming phosphating is a method for applying crystalline anti-corrosion coatings to metal surfaces, in particular to materials of the metals iron, zinc and aluminum, which has been used for decades and studied in depth. Zinc phosphating, which is particularly well established for corrosion protection, is carried out using a layer thickness of a few micrometers and is based on corrosive pickling of the metal material in an acidic aqueous composition containing zinc ions and phosphates. In the course of the pickling process, an alkaline diffusion layer forms on the metal surface, which extends into the interior of the solution and within which sparingly soluble crystallites form, which crystallites precipitate directly at the interface with the metal material and continue to grow there. To support the pickling reaction on materials of the metal aluminum and to mask the bath poison aluminum, which in dissolved form disturbs the layer formation on materials of the metal, water-soluble compounds which are a source of fluoride ions are often added. Zinc phosphating is always initiated by activation of the metal surfaces of the component to be phosphated. Wet-chemical activation is carried out conventionally by means of contact with colloidal aqueous solutions of phosphates ("activation stage"), which, insofar as they are immobilized on the metal surface, are used in the subsequent phosphating as a growth nucleus for the formation of the crystalline coating within the alkaline diffusion layer. Suitable dispersions in this case are colloidal, mostly neutral to alkaline aqueous compositions based on phosphate crystallites, which have only small crystallographic deviations in their crystal structure from the type of zinc phosphate layer to be deposited. In addition to the titanium phosphate commonly referred to in the literature as Jernstedt salt, water-insoluble bi- and trivalent phosphates are also suitable as starting materials for preparing a colloidal solution suitable for activating a metal surface for the zinc phosphating. In this connection, WO 98/39498 A1 teaches in particular bi- and trivalent phosphates of the metals Zn, Fe, Mn, Ni, Co, Ca and Al, it being technically preferred for phosphates of the metal zinc to be used for activation for subsequent zinc phosphating.

Any type of layer-forming phosphating as a process sequence of activation and zinc phosphating has unique characteristics, which become significant particularly in the treatment of components composed of a mix of different metal materials, or in the treatment of novel materials. Closed crystalline zinc phosphate coatings cannot be formed on steel surfaces of components activated with Jernstedt salts if, in the zinc phosphating bath, the content of dissolved aluminum exceeds a specific threshold value, for example in the case of components with a high aluminum content, and therefore activation according to WO 98/39498 A1 should be avoided. Activation of this kind also brings about the advantage that thinner and more corrosion-resistant phosphate coatings are achieved on the aluminum surfaces in comparison with activation with Jernstedt salts. However, in zinc phosphating baths in which aluminum surfaces are also intended to undergo layer-forming treatment, activation with bi- and trivalent phosphates often results in defective coatings on the zinc surfaces, which are characterized in that loose adhesions of constituents of the zinc phosphate coating can be observed which significantly reduce the coating adhesion on the zinc surfaces in the subsequent dip coating. In addition, the loose adhesions consisting of phosphates are partly carried over into a dip-coating that follows the zinc phosphating, where they are in turn partly dissolved in the aqueous binder dispersion. The dissolved phosphates introduced by being carried over into the dip coating can adversely affect the deposition characteristics of the dispersed coating constituents and can also reduce the effective concentration of essential catalysts/cross-linking agents based on selected heavy metals by precipitation reactions. Carrying over phosphates can thus be the cause of increased baking temperatures, in particular for dipping coatings which contain water-soluble or water-dispersible salts of yttrium and/or bismuth in addition to the dispersed resin.

However, for all other phosphating methods, for example zinc phosphating of composite structures, which is not adapted to form layers on the surfaces of the materials made of aluminum, there is still a need with respect to the established wet-chemical methods for activation to further stabilize the aqueous dispersions, from which the application baths for activation are prepared, as such against sedimentation or to optimize their property of activating metal surfaces for phosphating. The latter aspect includes above all the ability to bring about activation of the metal surfaces to be phosphated both as uniformly as possible and in a comprehensive manner, and thus to bring about the formation of homogeneous, finely crystalline coatings in the phosphating stage, such that a high electrical charge transfer resistance and thus a correspondingly good grip of the coating is achieved in the subsequent electrocoating in addition to excellent coating adhesion properties. Furthermore, sufficient activation should be accompanied by using as little as possible of the stabilized aqueous dispersion which is complex to produce and which acts as a concentrate of the application bath. With regard to the stabilization of such a concentrate against sedimentation, there is always the difficulty of redispersing active components that have already sedimented after a long standing time in a simple manner and making them available for activation. At the same time, the concentrate must be technically handleable and, particularly after redispersion for subsequent metering into the application bath of the activation, must be easy to pump.

This complex task profile is surprisingly addressed by the combination of a specific polymeric dispersing agent in the presence of a thickener. This special combination ensures the required flow behavior and the necessary stability against sedimentation by associating the dispersed primary particles, which bring about the activation of a metal surface through contact, with stabilized agglomerates. Moreover, the specific dispersing agent ensures that, when the concentration of the constituents of the dispersion is reduced, for example by dilution with water, primary particles are gradually released from the agglomerates, but without losing their stabilization against sedimentation.

A first aspect of the present invention therefore relates to an aqueous dispersion having a D50 value of more than 10 μm, containing (a) at least 5 wt. % of a dispersed particulate constituent comprising
  (a1) at least one particulate inorganic compound of a polyvalent metal cation, and
  (a2) at least one polymeric organic compound which is composed at least partially of styrene and/or an α-olefin having no more than 5 carbon atoms and maleic acid, its anhydride and/or its imide, and which additionally comprises polyoxyalkylene units, and (b) at least one thickener.

The dispersed particulate constituent (a) of the aqueous dispersion according to the present invention is the solids content that remains after drying the retentate of an ultrafiltration of a defined partial volume of the aqueous dispersion having a nominal cutoff limit of 10 kD (NMWC: nominal molecular weight cutoff). The ultrafiltration is carried out by adding deionized water ($\kappa<1$ $\mu Scm^{-1}$) until a conductivity of below 10 $\mu Scm^{-1}$ is measured in the filtrate.

In the context of the present invention, an organic compound is polymeric if its weight-average molar mass is greater than 500 g/mol. The molar mass is determined using the molar mass distribution curve of a sample of the relevant reference value, which curve is established experimentally at 30° C. by means of size-exclusion chromatography using a concentration-dependent refractive index detector and calibrated against polyethylene glycol standards. The analysis of the average molar masses is carried out with the aid of a computer according to the strip method with a third-order calibration curve. Hydroxylated polymethacrylate is suitable as a column material, and an aqueous solution of 0.2 mol/L sodium chloride, 0.02 mol/L sodium hydroxide, 6.5 mmol/L ammonium hydroxide is suitable as an eluent.

The aqueous dispersion according to the invention, in its function as a concentrate for the activation stage of phosphating, contains a sufficient amount of particulate constituents (a), a proportion of preferably at least 10 wt. %, particularly preferably of at least 15 wt. %, being more advantageous in this regard. A content of the particulate constituent (a) should not be set above 40 wt. % because the resulting technical handling behavior of the dispersion is usually poorer. The content of the particulate portion is therefore particularly preferably no more than 30 wt. %. In the context of the present invention, quantities concerning the composition of the aqueous dispersion according to the invention always relate to the dispersion as a reference value, unless another reference value is explicitly specified.

For activation, it is usually preferable to use polyvalent metal cations in the form of phosphates which are contained in the particulate constituent (a) for activation in a correspondingly high proportion. Accordingly, the at least one particulate inorganic compound (a1) of the dispersed particulate constituent (a) is preferably composed at least partially of phosphates. The content of these phosphates based on the dispersed inorganic particulate constituent calculated as $PO_4$ is preferably at least 25 wt. %, particularly preferably at least 35 wt. %, more particularly preferably at least 40 wt. %, very particularly preferably at least 45 wt. %. The inorganic particulate constituent of the aqueous dispersion is, in turn, that which remains when the particulate constituent (a) obtained from the drying of the ultrafiltration retentate is pyrolyzed in a reaction furnace by supplying a $CO_2$-free oxygen flow at 900° C. without admixture of catalysts or other additives until an infrared sensor provides a signal identical to the $CO_2$-free carrier gas (blank value) in the outlet of the reaction furnace. The phosphates contained in the inorganic particulate constituent are determined as phosphorus content by means of atomic emission spectrometry (ICP-OES) after acid digestion of the constituent with aqueous 10 wt. % $HNO_3$ solution at 25° C. for 15 min, directly from the acid digestion.

The active components of the aqueous dispersion which effectively promote the formation of a closed phosphate coating on the metal surfaces and in this sense activate the metal surfaces are, as already mentioned, preferably composed primarily of phosphates, which in turn preferably at least partially comprise hopeite, phosphophyllite, scholzite and/or hureaulite, particularly preferably at least partially comprise hopeite, phosphophyllite and/or scholzite, more particularly preferably at least partially comprise hopeite and/or phosphophyllite and very particularly preferably at least partially comprise hopeite for the formation of finely crystalline coatings. A preferred activation within the meaning of the present invention is thus substantially based on the phosphates in particulate form contained in the aqueous dispersion according to the invention. The phosphates hopeite, phosphophyllite, scholzite and/or hureaulite may be dispersed into an aqueous solution as components (a1) for providing the aqueous dispersion according to the invention as finely milled powders or as powder paste triturated together with the polymeric organic compound (a2) as dispersing agents. Without taking into account water of crystallization, hopeites stoichiometrically comprise $Zn_3(PO_4)_2$ and the nickel-containing and manganese-containing variants $Zn_2Mn(PO_4)_3$, $Zn_2Ni(PO_4)_3$, whereas phosphophyllite consists of $Zn_2Fe(PO_4)_3$, scholzite consists of $Zn_2Ca(PO_4)_3$ and hureaulite consists of $Mn_3(PO_4)_2$. The existence of the crystalline phases hopeite, phosphophyllite, scholzite and/or hureaulite in the aqueous dispersion according to the invention can be demonstrated by means of X-ray diffractometric methods (XRD) after separation of the particulate constituent (a) by means of ultrafiltration with a nominal cutoff limit of 10 kD (NMWC: nominal molecular weight cutoff) as described above and drying of the retentate to constant mass at 105° C.

Due to the preference for the presence of phosphates comprising zinc ions and having a certain crystallinity, it is preferred for the formation of firmly adherent crystalline zinc phosphate coatings after successful activation for the aqueous dispersion according to the invention to contain at least 20 wt. %, preferably at least 30 wt. %, particularly preferably at least 40 wt. % of zinc in the inorganic particulate constituent of the aqueous dispersion, based on the phosphate content of the inorganic particulate constituent, calculated as $PO_4$.

However, activation within the meaning of the present invention is preferably not achieved by means of colloidal solutions of titanium phosphates, since otherwise layer-forming zinc phosphating on iron, in particular steel, is not reliably achieved. In a preferred embodiment of the method according to the invention, the content of titanium in the inorganic particulate constituent of the aqueous dispersion is therefore less than 0.1 wt. %, particularly preferably less than 0.01 wt. %, based on the aqueous dispersion. In a particularly preferred embodiment, the aqueous dispersion for the activation contains a total of less than 10 mg/kg, particularly preferably less than 1 mg/kg of titanium.

It is also advantageous that, likewise due to the excellent dispersing properties of the polymeric organic compounds (a2), a high content of inorganic particulate constituent can be achieved, which is essential for the activation of the metal surfaces. In this respect, the aqueous dispersion can successfully have a content of the dispersed inorganic particulate constituent of preferably at least 60 wt. %, particularly preferably at least 80 wt. %, based on the amount of the dispersed particulate constituent (a).

The aqueous dispersion according to the invention is characterized by a D50 value of more than 10 μm. The agglomerates of the dispersed particles contained in the dispersion bring about the thixotropic flow properties which are favorable for its handling behavior. The tendency of the agglomerates to be highly viscous at low shear favors their long shelf life, while the loss of viscosity when sheared makes them pumpable. Favorable flow properties are also obtained if the dispersion does not significantly exceed a D90 value of 150 μm; therefore, according to the invention, a D90 value of the aqueous dispersion of less than 150 μm, preferably less than 100 μm, in particular less than 80 μm, is preferred.

In the context of the present invention, the D50 value or the D90 value denotes the particle diameter which is not exceeded by 50 vol. % or 90 vol. %, respectively, of the particulate constituents contained in the aqueous dispersion.

According to ISO 13320:2009, the D50 value or D90 value can be determined from volume-weighted cumulative particle size distributions by means of scattered light analysis according to Mie theory immediately after dilution of the dispersion on a dispersed particulate constituent of 0.05 wt. % with a corresponding amount of deionized water (□<1 $\mu Scm^{-1}$) at 20° C., using spherical particles and a refractive index of the scattering particles of $n_D=1.52-i\cdot 0.1$. The dilution is carried out in such a way that an amount of the dispersion corresponding to a volume of 200 mL of deionized water is added to the sample vessel of the LA-950 V2 particle size analyzer of the manufacturer Horiba Ltd. and is mechanically circulated there into the measuring chamber (setting of the circulating pump on the LA-950 V2: level 5=1167 rpm for a volume flow of 3.3 liters/minute). The particle size distribution is measured within 120 seconds after the dispersion has been added to the dilution volume.

The particulate constituent (a) contained in the aqueous dispersion according to the invention is at least partially present in agglomerates which have particle sizes above 10 μm. The agglomerates themselves are in turn composed of primary particles, so that the aqueous dispersions according to the invention preferably have a bimodal particle size distribution and particularly preferably a distribution maximum for a particle size below 1 μm and another for a particle size above 10 μm. A bimodal particle size distribution is present if the volume-weighted particle size distribution curve has at least two separate distribution maxima, preferably such that the ratio of the intensities in the distribution maxima to the intensity in the distribution minimum lying between the distribution maxima is greater than 2 in each case.

Within the meaning of the present invention, the polymeric organic compounds (a2) which are used as dispersing agents and have polyoxyalkylene units are composed at least partially of styrene and/or an α-olefin having no more than 5 carbon atoms and maleic acid, its anhydride and/or its imide. The α-olefin in this case is preferably selected from ethene, 1-propene, 1-butene, isobutylene, 1-pentene, 2-methyl-but-1-ene and/or 3-methyl-but-1-ene and particularly preferably selected from isobutylene. It is clear to the person skilled in the art that the polymeric organic compounds (a2) contain these monomers as structural units in unsaturated form covalently linked to one another or to other structural units. Suitable commercially available representatives are, for example, Dispex® CX 4320 (BASF SE), a maleic acid-isobutylene copolymer modified with polypropylene glycol, Tego® Dispers 752 W (Evonik Industries AG), a maleic acid-styrene copolymer modified with polyethylene glycol, or Edaplan® 490 (Münzing Chemie GmbH), a maleic acid-styrene copolymer modified with EO/PO and imidazole units. In the context of the present invention, polymeric organic compounds (a2) which are composed at least partially of styrene are preferred.

The polymeric organic compounds (a2) used as dispersing agents have polyoxyalkylene units which are preferably composed of 1,2-ethanediol and/or 1,2-propanediol, particularly preferably of both 1,2-ethanediol and 1,2-propanediol, the content of 1,2-propanediols in the entirety of the polyoxyalkylene units being preferably at least 15 wt. %, but particularly preferably not exceeding 40 wt. %, based on the entirety of the polyoxyalkylene units. Furthermore, the polyoxyalkylene units are preferably contained in the side chains of the polymeric organic compounds (a2). A content of the polyoxyalkylene units in the entirety of the polymeric organic compounds (a2) of preferably at least 40 wt. %, particularly preferably at least 50 wt. %, but preferably no more than 70 wt. %, is advantageous for the dispersibility.

For anchoring the dispersing agent with the inorganic particulate constituent of the aqueous dispersion, which in a preferred embodiment is at least partially formed of polyvalent metal cations in the form of phosphates, the organic polymeric compounds (a2) also have imidazole units, preferably such that the polyoxyalkylene units of the polymeric organic compounds (a2) are at least partially end-capped with an imidazole group, and therefore in the preferred embodiment terminal imidazole groups are present in the polyoxyalkylene side chain, the covalent linkage of the polyoxyalkylene units with the imidazole group preferably being carried out via a nitrogen atom of the heterocycle. In a preferred embodiment, the amine value of the organic polymeric compounds (a2) is at least 25 mg KOH/g, particularly preferably at least 40 mg KOH/g, but preferably less than 125 mg KOH/g, particularly preferably less than 80 mg KOH/g, and therefore, in a preferred embodiment, the entirety of the polymeric organic compounds in the particulate constituent (a) also have these preferred amine values. The amine value is determined in each case by weighing out approximately 1 g of the relevant reference value—organic polymeric compounds (a2) or the entirety of the polymeric organic compounds in the particulate constituent—in 100 mL of ethanol, titration being carried out using 0.1 N HCl titrant solution against the indicator bromophenol blue until the color changes to yellow at a temperature of the ethanolic solution of 20° C. The amount of HCl titrant solution used in milliliters multiplied by the factor 5.61 divided by the exact mass of the weight in grams corresponds to the amine value in milligrams KOH per gram of the relevant reference value.

The presence of maleic acid, insofar as it is a constituent of the organic polymeric compound (a2) as a free acid and not in the form of the anhydride or imide, can impart increased water solubility of the dispersing agent, in particular in the alkaline range. It is therefore preferred for the polymeric organic compounds (a2), preferably also the entirety of the polymeric organic compounds in the particulate constituent (a), to have an acid number according to DGF CV 2 (06) (as of April 2018) of at least 25 mg KOH/g, but preferably of less than 100 mg KOH/g, particularly preferably of less than 70 mg KOH/g to ensure a sufficient number of polyoxyalkylene units. It is also preferred for the polymeric organic compounds (a2), preferably also the entirety of the polymeric organic compounds in the particulate constituent (a), to have a hydroxyl number of less than 15 mg KOH/g, particularly preferably of less than 12 mg KOH/g, more particularly preferably of less than 10 mg KOH/g, determined according to method A of 01/2008: 20503 from European Pharmacopoeia 9.0 in each case.

For sufficient dispersion of the inorganic particulate constituents of the dispersion, it is sufficient for the content of the polymeric organic compounds (a2), preferably the entirety of the polymeric organic compounds in the particulate constituent (a), based on the particulate constituent (a), to be at least 3 wt. %, particularly preferably at least 6 wt. %, but preferably not exceeding 15 wt. %.

The presence of a thickener according to component (b) gives the aqueous dispersion, in combination with its particulate constituent, the above-mentioned desired flow behavior and thereby prevents the irreversible formation of agglomerates in the particulate constituent, from which primary particles cannot be detached. According to the invention, the addition of the thickener makes it possible to achieve preferred aqueous dispersions according to the invention which have a maximum dynamic viscosity of at least 1000 Pa·s, but preferably of below 5000 Pa·s, at a temperature of 25° C. in the shear rate range of from 0.001 to 0.25 reciprocal seconds, and preferably exhibit shear thinning behavior at 25° C. at shear rates above that which is present at the maximum dynamic viscosity, i.e. a decrease in viscosity as the shear rate increases, such that the aqueous dispersion as a whole has thixotropic flow behavior. The viscosity over the specified shear rate range can be determined using a cone and plate viscometer with a cone diameter of 35 mm and a gap width of 0.047 mm.

According to the present invention, a thickener according to component (b) is a polymeric chemical compound or a defined mixture of chemical compounds which, as a 0.5 wt. % constituent in deionized water (□<1 $\mu Scm^{-1}$) at a temperature of 25° C., has a Brookfield viscosity of at least 100 mPa·s at a shear rate of 60 rpm (=rounds per minute) using a size 2 spindle. When determining this thickener property, the mixture should be mixed with water in such a way that the corresponding amount of the polymeric chemical compound is added to the water phase at 25° C. while stirring and the homogenized mixture is then freed of air bubbles in an ultrasonic bath and left to stand for 24 hours. The measurement value of the viscosity is then read within 5 seconds immediately after application of a shear rate of 60 rpm by the number 2 spindle.

An aqueous dispersion according to the invention, in order to provide a D50 value of more than 10 μm and the associated advantageous thixotropic flow behavior, preferably contains a total of at least 0.5 wt. %, but preferably no more than 4 wt. %, particularly preferably no more than 3 wt. % of one or more thickeners according to component (b), the total content of polymeric organic compounds in the non-particulate constituent of the dispersion according to the invention preferably not exceeding 4 wt. % (based on the dispersion). The non-particulate constituent is the solids content of the dispersion according to the invention in the permeate of the above-described ultrafiltration after it has been dried to constant mass at 105° C.—that is, the solids content after the particulate constituent has been separated by means of ultrafiltration.

Certain classes of polymeric compounds are particularly suitable thickeners according to component (b) of the first aspect of the present invention and are also readily commercially available. In this connection, the thickener according to component (b) is above all preferably selected from polymeric organic compounds, which in turn are preferably selected from polysaccharides, cellulose derivatives, aminoplasts, polyvinyl alcohols, polyvinylpyrrolidones, polyurethanes and/or urea urethane resins, and particularly preferably from urea urethane resins which associate in combination with the dispersed constituents in such a way that even small amounts of such a thickener are sufficient to form stable agglomerates in the dispersion, which bring about the desired D50 value of more than 10 μm and also cause the above-described preferred thixotropic flow behavior, such that the dispersion has both a long shelf life and excellent pumpability, which plays a technically important role when the dispersion is being metered in for readjustment of the activation stage.

A urea urethane resin as a thickener according to component (b) of the present invention is a mixture of polymeric compounds which results from the reaction of a polyvalent isocyanate with a polyol and a mono- and/or diamine. In a preferred embodiment, the urea urethane resin results from a polyvalent isocyanate, preferably selected from 1,4-tetramethylene diisocyanate, 1,6-hexamethylene diisocyanate, 2,2(4),4-trimethyl-1,6-hexamethylene diisocyanate, 1,10-decamethylene diisocyanate, 1,4,-cyclohexylene diisocyanate, p-phenylene diisocyanate, m-phenylene diisocyanate, 2,6-toluene diisocyanate, 2,4-toluene diisocyanate and mixtures thereof, p- and m-xylylene diisocyanate, and 4-4'-diisocyanatodicyclohexylmethane, particularly preferably selected from 2,4-toluenediisocyanate and/or m-xylylene diisocyanate. In a preferred embodiment, the urea urethane resin results from a polyol selected from polyoxyalkylene diols, particularly preferably from polyoxyethylene glycols, which in turn are preferably composed of at least 6, particularly preferably at least 8, more particularly preferably at least 10, but preferably less than 26, particularly preferably less than 23 oxyalkylene units.

Urea urethane resins which are particularly suitable and therefore preferred according to the invention can be obtained by first reacting a diisocyanate, for example toluene-2,4-diisocyanate, with a polyol, for example a polyethylene glycol, so as to form NCO-terminated urethane prepolymers, subsequently further reacted with a primary monoamine and/or with a primary diamine, for example m-xylylenediamine. Urea urethane resins which have neither free nor blocked isocyanate groups are particularly preferred. Such urea urethane resins, as a component of alkaline aqueous dispersions according to the invention, promote the formation of loose agglomerates of primary particles and thus both the preferred thixotropic flow behavior and the provision of dispersions which have the bimodal particle size distribution which is advantageous according to the invention; however, the agglomerates are in turn stabilized in the aqueous phase and protected against further agglomeration to the extent that the sedimentation of the particulate constituent is largely prevented. To further promote this property profile, urea urethane resins which have neither free or blocked isocyanate groups nor terminal amine groups are preferably used as component (b). In a preferred embodiment, the thickener according to component (b), which is a urea urethane resin, therefore has an amine value of less than 8 mg KOH/g, particularly preferably of less than 5 mg KOH/g, more particularly preferably of less than 2 mg KOH/g, determined according to the method as previously described for the organic polymeric compound a2) in each case. Since the thickener is substantially dissolved in the aqueous phase and can thus be assigned to the non-particulate constituent of the aqueous dispersion, while component (a2) is substantially bound in the particulate constituent, an aqueous dispersion in which the entirety of the polymeric organic compounds in the non-particulate constituent preferably has an amine value of less than 16 mg KOH/g, particularly preferably of less than 10 mg KOH/g, more particularly preferably of less than 4 mg KOH/g, is preferred. It is further preferred for the urea urethane resin to have a hydroxyl number in the range of from 10 to 100 mg KOH/g, particularly preferably in the range of from 20 to 60 mg KOH/g, determined according to method A of 01/2008: 20503 from European Pharmacopoeia 9.0. With regard to the molecular weight, a weight-average molar mass of the urea urethane resin in the range of from 1000 to 10000 g/mol, preferably in the range of from 2000 to 6000 g/mol, is advantageous according to the invention and therefore preferred, in each case determined experimentally, as previously described in connection with the definition according to the invention of a polymeric compound.

Without the addition of auxiliaries, the pH of the dispersion is usually in the range of from 6.0-9.0, and such a pH range is therefore preferred according to the invention. For compatibility with the actual and regularly alkaline colloidal aqueous solution in the activation stage, however, it is advantageous for the pH of the aqueous dispersion to be above 7.2, particularly preferably above 8.0, if necessary as a result of adding compounds that react in an alkaline manner. Since some polyvalent metal cations have an amphoteric character and can therefore be detached from the particulate constituent at higher pH values, the alkalinity of the aqueous dispersion according to the invention is ideally limited, such that the pH of the aqueous dispersion is preferably below 10 and particularly preferably below 9.0. The "pH" as used in the context of the present invention corresponds to the negative common logarithm of the hydronium ion activity at 20° C. and can be determined by means of pH-sensitive glass electrodes.

An aqueous dispersion according to the invention described above can preferably be obtained by i) providing a pigment paste by triturating 10 parts by mass of a particulate inorganic compound (a1) with 0.5 to 2 parts by mass of the polymeric organic compound (a2) in the presence of 4 to 7 parts by mass of water and grinding until a D90 value of less than 5 μm has been reached;

ii) diluting the pigment paste with such an amount of water and a thickener (b) that a dispersed particulate constituent (a) of at least 5 wt. % and a maximum dynamic viscosity of at least 1000 Pa·s at a temperature of 25° C. in the shear rate range of from 0.001 to 0.25 reciprocal seconds is set; and iii) setting a pH in the range of from 7.2 to 10.0 using a compound that reacts in an alkaline manner, preferred embodiments of the dispersion being obtained similarly by selecting corresponding components (a1), (a2) and (b) in the provided or required amount as necessary in each case.

The aqueous dispersion according to the invention can also contain auxiliaries, for example selected from preservatives, wetting agents and defoamers, which are contained in the amount necessary for the relevant function. The content of auxiliaries, particularly preferably of other compounds in the non-particulate constituent which are not thickeners and not compounds that react in an alkaline manner, is preferably less than 1 wt. %. In the context of the present invention, a compound that reacts in an alkaline manner is water-soluble (water solubility: at least 10 g per kg of water with □<1 $\mu Scm^{-1}$) and has a $pK_B$ value of above 8.0 for the first protonation step.

In a further, second aspect, the present invention relates to a method for anti-corrosion pretreatment based on phosphating and involving an aqueous dispersion according to the first aspect of the present invention. The method according to the invention in accordance with this second aspect relates to the anti-corrosion pretreatment of a metal material selected from zinc, iron or aluminum or of a component which is composed at least partially of such metal materials, in which method the metal material or the component undergoes firstly activation (i) and then phosphating (ii) in successive method steps, the activation in method step (i) being carried out by bringing the metal material or at least one metal material of the component into contact with a colloidal aqueous solution which can be obtained as an aqueous dispersion diluted by a factor of 20 to 100,000 according to the first aspect of the present invention.

For sufficient activation of all metal materials selected from zinc, aluminum and iron, the content of the particulate constituent of the colloidal aqueous solution should be adjusted accordingly. The aqueous dispersion according to the first aspect of the present invention is distinguished by the fact that a relatively small content of inorganic particulate constituents in the colloidal aqueous solution of the activation stage is required for activation of the metal surfaces, in particular a relatively small content of phosphates in the inorganic particulate constituent. Therefore, in the context of the second aspect of the present invention, a method is preferred in which the content of the inorganic particulate constituent, based on the colloidal aqueous solution of the activation stage in method step (i), is at least 5 mg/kg, preferably at least 20 mg/kg, particularly preferably at least 50 mg/kg, preferably as a content of phosphates in the inorganic particulate constituent calculated as $PO_4$ and based on the colloidal aqueous solution in each case. For economic reasons and for reproducible coating results, the activation should be carried out with maximally diluted colloidal aqueous solutions. It is therefore preferred for the content of the inorganic particulate constituent, based on the colloidal aqueous solution of the activation stage, to be less than 0.5 g/kg, particularly preferably less than 0.4 g/kg, more particularly preferably less than 0.3 g/kg, preferably as a content of phosphates in the inorganic particulate constituent calculated as $PO_4$ and based on the colloidal aqueous solution in each case.

The particulate constituents of the colloidal aqueous solution of the activation stage in the second aspect of the present invention are determined similarly to those of the aqueous dispersion according to the first aspect of the present invention, and are therefore also similarly defined.

When the treatment of a metal material selected from zinc, iron or aluminum is referenced in the context of the second aspect of the present invention, all materials which contain more than 50 at. % of the relevant element are included. Anti-corrosion pretreatment always relates to the surfaces of the material or component. The material can be a uniform material or a coating. According to the invention, galvanized steel grades consist both of the material steel and of the material zinc, it being possible for surfaces of iron to be exposed at the cutting edges and cylindrical grinding points of, for example, an automobile body which is made of galvanized steel, in which case according to the invention there is pretreatment of the material iron.

The components treated according to the second aspect of the present invention can all be three-dimensional structures of any shape and design that originate from a manufacturing process, in particular also including semi-finished products such as strips, metal sheets, rods, pipes, etc., and composite structures assembled from said semi-finished products, the semi-finished products preferably being interconnected by means of adhesion, welding and/or flanging to form composite structures.

There may be a rinsing step between the activation and the phosphating in order to reduce the carryover of alkaline constituents into the mostly acidic phosphating, but a rinsing step is preferably dispensed with in order to fully maintain the activation performance. A rinsing step is used exclusively for the complete or partial removal of soluble residues, particles and active components that are carried over by adhering to the component from a previous wet-chemical treatment step, from the component to be treated, without metal-element-based or semi-metal-element-based active components, which are already consumed merely by bringing the metal surfaces of the component into contact with the rinsing liquid, being contained in the rinsing liquid itself. For example, the rinsing liquid can simply be city water or deionized water or, if necessary, can also be a rinsing liquid which contains surface-active compounds to improve the wettability by means of the rinsing liquid.

For layer-forming phosphating and the formation of semi-crystalline coatings, which are the aim of the activation of the metal materials, it is preferred for the phosphating in method step (ii) by bringing the surfaces into contact with an acidic aqueous composition containing 5-50 g/kg of phosphates dissolved in water calculated as $PO_4$ and preferably additionally containing at least one source of free fluoride. According to the invention, the amount of phosphate ions includes the orthophosphoric acid and the anions, dissolved in water, of the salts of orthophosphoric acid, calculated as $PO_4$.

In a particular embodiment of the second aspect of the present invention, the subsequent phosphating is zinc phosphating and the phosphating in method step (ii) is based on an acidic aqueous composition containing 0.3-3 g/kg of zinc ions, preferably on an acidic aqueous composition containing 5-50 g/L of phosphate ions, 0.3-3 g/L of zinc ions and an amount of free fluoride.

A source of free fluoride ions is essential for the process of layer-forming zinc phosphating, insofar as the layer formation on all metal materials selected from zinc, iron or aluminum is desired, and is required, for example, for zinc phosphating of automobile bodies, which are at least partially made of aluminum. If all surfaces of the metal materials of a component are provided with a phosphate coating, the amount of the particulate constituents in the activation must often be adapted to the amount of free fluoride required for layer formation in the zinc phosphating. In a method according to the second aspect based on activation followed by zinc phosphating, in which the components to be pretreated are made from metal materials of zinc and iron, in particular steel, it is advantageous for a closed and defect-free phosphate coating for the amount of free fluoride in the acidic aqueous composition to be at least 0.5 mmol/kg. If the component is also made of the metal material aluminum and if its surfaces are also to be provided with a closed phosphate coating, then it is also preferred in the method according to the invention in accordance with the second aspect for the amount of free fluoride in the acidic aqueous composition to be at least 2 mmol/kg. The concentration of free fluoride should not exceed values above which the phosphate coatings predominantly have adhesions that can be easily wiped off, since these adhesions cannot be avoided even by a disproportionately increased amount of particulate constituents in the colloidal aqueous solution of the activation. Therefore, it is also economically advantageous, and therefore preferred, for the concentration of free fluoride in the acidic aqueous composition of the zinc phosphating to be below 15 mmol/kg, particularly preferably below 10 mmol/kg and more particularly preferably below 8 mmol/kg in the method according to the invention according to the second aspect of the present invention based on activation followed by zinc phosphating.

The amount of free fluoride can be determined potentiometrically by means of a fluoride-sensitive measuring electrode at 20° C. in the relevant acidic aqueous composition after calibration with fluoride-containing buffer solutions without pH buffering. Suitable sources of free fluoride are hydrofluoric acid and the water-soluble salts thereof, such as ammonium bifluoride and sodium fluoride, as well as complex fluorides of the elements Zr, Ti and/or Si, in particular complex fluorides of the element Si. In a phosphating process according to the second aspect of the present invention, the source of free fluoride is therefore preferably selected from hydrofluoric acid and its water-soluble salts and/or complex fluorides of the elements Zr, Ti and/or Si. Salts of hydrofluoric acid are water-soluble within the meaning of the present invention if their solubility in deionized water (□<1 $\mu Scm^{-1}$) at 60° C. is at least 1 g/L, calculated as F.

In order to suppress what is known as "pin-holing" on the surfaces of the metal materials which are made of zinc, it is preferred, in the context of the second aspect of the present invention and a set-up in which the activation is followed by zinc phosphating, for the source of free fluoride to be at least partially selected from complex fluorides of the element Si, in particular from hexafluorosilicic acid and the salts thereof. The term pin-holing is understood by a person skilled in the art of phosphating to mean the phenomenon of local deposition of amorphous, white zinc phosphate in an otherwise crystalline phosphate layer on the treated zinc surfaces or on the treated galvanized or alloy-galvanized steel surfaces. Pin-holing is caused in this case by a locally increased pickling rate of the substrate. Such point defects in the phosphating can be the starting point for corrosive delamination of subsequently applied organic coating systems, and therefore the occurrence of pin-holes should be largely avoided in practice. In this context, it is preferred for the concentration of silicon in water-dissolved form in the acidic aqueous composition of the zinc phosphating in method step (ii) to be at least 0.5 mmol/kg, particularly preferably at least 1 mmol/kg, more particularly preferably at least 2 mmol/kg, but preferably less than 15 mmol/kg, particularly preferably less than 12 mmol/kg, more particularly preferably less than 10 mmol/kg and very particularly preferably less than 8 mmol/kg. The upper limits for the concentration of silicon are preferred because above these values, phosphate coatings are favored which mostly have loose adhesions, which cannot be avoided even by a disproportionately high amount of particulate constituents in the colloidal aqueous solution of the activation stage. The concentration of silicon in the acidic aqueous composition in water-dissolved form can be determined by means of atomic emission spectrometry (ICP-OES) in the filtrate of a membrane filtration of the acidic aqueous composition that is carried out using a membrane having a nominal pore size of 0.2 μm.

With regard to the interaction of activation and zinc phosphating, it has been found that the content of particulate constituents contributing to activation has to be adapted to the amount of free fluoride and silicon in the zinc phosphating in order to ensure that the higher amounts of free fluoride for layer-forming phosphating on components comprising aluminum as a metal material contained in the phosphating bath do not have a disadvantageous effect on the layer formation, which is of great importance to a constant quality of the phosphate coatings, in particular when pretreating a large number of components. The aqueous dispersion according to the first aspect of the present invention assists the formation of defect-free zinc phosphate coatings to a considerable degree here.

In this sense, the method preferred according to the second aspect of the present invention is a method in which a series of components is to be pretreated, which series comprises components which are at least partially made of the materials zinc and aluminum, and in which the components of the series are subjected firstly to activation (i) and then to phosphating (ii) in consecutive method steps, the activation in method step (i) being carried out by bringing the component into contact with a colloidal aqueous solution which can be obtained as an aqueous dispersion diluted by a factor of from 20 to 100,000 according to the first aspect of the present invention, the dispersed particulate constituent (a) of which is composed at least partially of phosphates, and the phosphating in method step (ii) being carried out by contact with an acidic aqueous composition containing (a) 5-50 g/L of phosphate ions, (b) 0.3-3 g/L of zinc ions, and (c) at least one source of free fluoride, wherein the quotient of the concentration of the phosphates in the inorganic particulate constituent of the colloidal aqueous solution of the activation in mmol/kg, based on $PO_4$, with respect to the sum of the concentration of free fluoride and the concentration of silicon in each case in the acidic aqueous composition of the zinc phosphating and in each case in mmol/kg is greater than 0.2, preferably greater than 0.3, particularly preferably greater than 0.4.

The concentration of the phosphates contained in the inorganic particulate constituent of the colloidal aqueous solution can be determined as phosphorus content by means of atomic emission spectrometry (ICP-OES) after acid digestion of the constituent with aqueous 10 wt. % $HNO_3$ solution at 25° C. for 15 min, directly from the acid digestion.

Auxiliaries which ensure the stability of the inorganic particulate constituent dispersed in the colloidal aqueous solution are usually added to said solution. Particularly when the colloidal aqueous solution is obtained by diluting an aqueous dispersion according to the first aspect of the present invention, the inorganic particulate constituent of which is composed at least partially of phosphates, it is preferred for water-soluble phosphates, in particular pyrophosphates, to also be contained in the colloidal aqueous solution of the activation and to be added in an amount of preferably at least 5 mg/kg, particularly preferably at least 20 mg/kg, more particularly preferably at least 50 mg/kg, but preferably no more than 500 mg/kg, particularly preferably no more than 200 mg/kg. The non-particulate constituent of the colloidal aqueous solution is determined or separated similarly to that of the aqueous dispersion according to the first aspect of the present invention.

Furthermore, complexing agents can be added to the colloidal aqueous solution of the activation (i) in the method according to the second aspect of the present invention for stabilizing the polyvalent metal cations which are dissolved in the aqueous phase and which are in chemical equilibrium with the particulate phosphate content. It is particularly advantageous to add α-hydroxycarboxylic acids such as gluconic acid, citric acid, tartaric acid, tartronic acid, glycolic acid, lactic acid and/or organic phosphonic acids such as aminotrimethylenephosphonic acid, diethylenetriaminepenta(methylenephosphonic acid), ethylenediaminetetra(methylenephosphonic acid) or 1-hydroxyethane-(1,1-diphosphonic acid). Adding 1-hydroxyethane-(1,1-diphosphonic acid) as a complexing agent has proven particularly useful in this context.

The colloidal aqueous solution in the activation (i) of the method according to the second aspect of the present invention preferably has an alkaline pH, particularly preferably a pH above 8.0, more particularly preferably above 9.0, but preferably below 11.0, it being possible to use compounds which influence the pH, such as phosphoric acid, sodium hydroxide solution, ammonium hydroxide or ammonia, to adjust the pH.

Anti-corrosion treatment of the components in series is when a large number of components are brought into contact with treatment solution provided in the respective treatment steps and conventionally stored in system tanks, the individual components being brought into contact successively and thus at different times. In this case, the system tank is the container in which the pretreatment solution is located for the purpose of anti-corrosion treatment in series.

Insofar as zinc phosphating in method step (ii) is mentioned in the context of the second aspect of the present invention, the preferred pH of the acidic aqueous composition which brings about the zinc phosphating is above 2.5, particularly preferably above 2.7, but is preferably below 3.5, particularly preferably below 3.3. The content of the free acid in points in the acidic aqueous composition of the zinc phosphating in method step (ii) is preferably at least 0.4, but preferably no more than 3.0, particularly preferably no more than 2.0. The proportion of free acid in points is determined by diluting 10 mL sample volume of the acidic aqueous composition to 50 mL and titrating with 0.1 N sodium hydroxide solution to a pH of 3.6. The consumption of mL of sodium hydroxide solution indicates the point number of the free acid.

The conventional addition of additives for zinc phosphating can also be carried out similarly in the context of the second aspect of the present invention, such that the acidic aqueous composition can contain the conventional accelerators such as hydrogen peroxide, nitrite, hydroxylamine, nitroguanidine and/or N-methylmorpholine-N-oxide, cations of the metals manganese, calcium and/or iron in the form of water-soluble salts are also added, which have a positive influence on layer formation. In an embodiment that is preferred for environmental hygiene reasons, in total less than 10 ppm of nickel and/or cobalt ions are contained in the acidic aqueous composition of the zinc phosphating in method step (ii).

In the method according to the invention, a good coating primer for a subsequent dip coating, in the course of which a substantially organic cover layer is applied, is produced. Accordingly, in a preferred embodiment of the method according to the invention, the zinc phosphating, with or without an intermediate rinsing and/or drying step, but preferably with a rinsing step and without a drying step, is followed by dip coating, particularly preferably electrocoating, particularly preferably cathodic electrocoating, which preferably contains water-soluble or water-dispersible salts of yttrium and/or bismuth in addition to the dispersed resin, which preferably comprises an amine-modified polyepoxide.

EMBODIMENTS

The properties of a dispersion according to the invention with regard to stability, flow behavior and suitability for activation in zinc phosphating are set out below.

Preparation of the Pigment Paste

To prepare a pigment paste for providing a dispersion according to the invention, 15 parts by mass of Edaplan® 490 (Münzing Chemie GmbH) were predispersed as dispersing agents in 25 parts by weight of fully deionized water (□<1 $\mu Scm^{-1}$) and then mixed with 60 parts by mass of zinc phosphate of quality level PZ 20. This phase was transferred to a KDL type Dyno®-Mill bead mill and the zinc phosphate particles were continuously milled for two hours (milling parameters: 75% bead fill level, 2000 revolutions per minute, 20 L volumetric flow per hour, temperature of the milled material 40-45° C.). The result was an average particle size of approximately 0.35 μm determined using a Zetasizer Nano ZS from Malvern. On the basis of the dispersing agents to be used according to the invention, in this case Edaplan® 490, an optimal primary particle size for activation can therefore be achieved with conventional acceptable mechanical or time expenditure.

Preparation of the Dispersion According to the Invention 2.5 parts by mass of a urea urethane resin solution containing 40 wt. % of the resin based on an amine-modified prepolymer of TDI XDI and PEG-16 (amine value<1 mg KOH/g; hydroxyl number approximately 40 mg KOH) in approximately 64 parts by mass of fully deionized water (□<1 $\mu Scm^{-1}$) was then supplied as a thickener, homogenized, and adjusted to pH 9 using 10% sodium hydroxide solution. Then, approximately 33 parts by mass of the pigment paste were added while stirring, adjusted to pH 9 using 1 wt. % NaOH solution and stirred to the point of complete homogenization. A sample of the dispersion according to the invention produced in this way was analyzed by laser diffraction in accordance with ISO 13320: 2009 as specified in the description. For this purpose, 110 mg of the dispersion was added to 200 mL of fully deionized water (□<1 $\mu Scm^{-1}$) and the sample volume provided in this way was placed into the Retsch Horiba LA-950 particle analyzer, and after 60 seconds the particle size distribution curve in the sample volume was determined by laser diffraction. After evaluation as specified in the description a D50 value of 29 μm was obtained (D10 value: 0.4 μm; D90 value: 57 μm).

The dispersion according to the invention has a pronounced thixotropic flow behavior with a maximum viscosity of 2200 Pas at a shear rate of 0.002 $s^{-1}$ and a dynamic viscosity below 100 Pas at a shear rate of 0.1 $s^{-1}$, in each case determined at 25° C. using a cone and plate viscometer with a cone diameter of 35 mm and a gap width of 0.047 mm. This is advantageous for preventing sedimentation during storage of the dispersion, and also facilitates pumpability and thus the provision and readjustment of activation baths during zinc phosphating.

Preparation of an Activation Solution for Zinc Phosphating According to the Invention 5 liters of fully deionized water (□<1 $\mu Scm^{-1}$) was provided in a 5 L beaker and mixed with 3 grams of an additive solution containing 20.4 wt. % potassium pyrophosphate and 28 wt. % potassium phosphate and brought to pH 10.5 using phosphoric acid while stirring, and 10 grams of the dispersion according to the invention was added. The pH was then adjusted to 10.5 using 1% sodium hydroxide solution while stirring.

Use of the Activation Solution in Zinc Phosphating According to the Invention

For layer-forming phosphating by activation based on the dispersion according to the invention, sheets of cold-rolled steel (CRS), hot-dip galvanized steel (HDG) and aluminum (AA6014) were:

a) firstly alkaline cleaned while stirring in service water (pH: 10.2-10.9; 55° C.) by being immersed for 5 minutes in a degreasing bath containing 4 wt. % of Bonderite® C-AK 1565 A and 0.6 wt. % of Bonderite® C-AD 1561, each of which is available from Henkel AG & Co. KGaA;
b) subjected to rinsing under service water and then under fully deionized water (□<1 $\mu Scm^{-1}$) for approximately 30 seconds in each case;
c) in a water-wetted state, brought into contact with the activation solution by immersion for 60 seconds;
d) and immediately afterwards, and without further rinsing steps, immersed into a hydroxylamine-accelerated phosphating bath having a free acid content of 0.9-1.4 points (titrated to a pH of 3.6), a total acid content of 25-30 points (titrated to a pH of 8.5) and a free fluoride content of approximately 150 mg/kg, containing 4.6 wt. % of Bonderite® M-ZN 1994, 0.8 wt. % of Bonderite® M-AD 565, 0.24 wt. % of Bonderite® M-AD 338 and 0.38 wt. % of Bonderite® M-AD 110, each of which is available from Henkel AG & Co. KGaA, in fully deionized water (□<1 $\mu Scm^{-1}$), for 3 min while stirring at 52° C.;
e) subjected to rinsing with fully deionized water (□<1 $\mu Scm^{-1}$) for approximately 30 s; and
f) provided with an approximately 20 μm thick layer of an electrocoat of the type Cathoguard® 800 (BASF SE) and then cured at 180° C. for 35 min.

Table 1 summarizes the results of zinc phosphating with regard to layer weight and after aging in the corrosion test. It is apparent that homogeneous, closed zinc phosphate coatings are always produced and excellent anti-corrosion results are achieved at a relatively low layer weight.

TABLE 1

| Substrate | Layer weight[1]/$gm^{-2}$ | Corrosion[2,3]/mm |
|---|---|---|
| CRS | 1.6 | 0.5[2] |
| HDG | 2.1 | 1.8[2] |
| AA6014 | 1.6 | 3.5[3] |

[1]differential gravimetric determination after detaching the phosphate layer in aqueous 5 wt. % chromic acid solution.
[2]delamination at the scratch after aging in a VW PV1210 alternating climate test for 6 weeks over 30 cycles
[3]longest filiform corrosion thread according to DIN EN 3665

What is claimed is:

1. An aqueous dispersion having a D50 value of more than 10 μm, containing:

(a) at least 5 wt. % of a dispersed particulate constituent comprising
  (a1) at least one particulate inorganic compound of a polyvalent metal cation; and
  (a2) at least one polymeric organic compound composed at least partially of styrene, an α-olefin having no more than 5 carbon atoms or a combination thereof;
    said at least one polymeric organic compound also comprising maleic acid, its anhydride, its imide or combinations thereof; and which—additionally comprises polyoxyalkylene units;
  and
(b) at least one thickener.

2. The dispersion according to claim 1, wherein the at least one particulate inorganic compound (a1) of the dispersed particulate constituent (a) is composed at least partially of phosphates, present in an amount of at least 25 wt. % based on the dispersed inorganic particulate constituent calculated as $PO_4$.

3. The dispersion according to claim 2, wherein the phosphates present in the at least one particulate inorganic compound (a1) are composed at least partially of one or more of hopeite, phosphophyllite, scholzite and hureaulite.

4. The dispersion according to claim 1, wherein the aqueous dispersion has a D90 value of less than 150 μm.

5. The dispersion according to claim 1, wherein the aqueous dispersion has a bimodal particle size distribution and optionally one distribution maximum for a particle size below 1 μm and another distribution maximum for a particle size above 10 μm.

6. The dispersion according to claim 1, wherein the polymeric organic compounds (a2) contain the polyoxyalkylene units in their side chains, and total content of the polyoxyalkylene units in the polymeric organic compounds (a2) is at least 40 wt. %, but does not exceed 70 wt. %.

7. The dispersion according to claim 1, wherein the polymeric organic compounds (a2) further comprise imidazole units.

8. The dispersion according to claim 7, wherein the polyoxyalkylene units of the polymeric organic compounds (a2) are at least partially end-capped with an imidazole group.

9. The dispersion according to claim 1, wherein the polymeric organic compounds in the particulate constituent (a) have a total amine value of at least 25 mg KOH/g, but less than 125 mg KOH/g.

10. The dispersion according to claim 1, wherein the polymeric organic compounds in and based on the particulate constituent (a) is at least 3 wt. % and does not exceed 15 wt. %.

11. The dispersion according to claim 1, wherein the at least one thickener according to component (b) is selected from urea urethane resins which have an amine value of less than 8 mg KOH/g.

12. The dispersion according to claim 1, wherein the thickeners according to component (b) are present in an amount of at least 0.5 wt. %, and the total content of polymeric organic compounds in the non-particulate constituent does not exceed 4 wt. %.

13. The dispersion according to claim 1, wherein the aqueous dispersion has a pH of above 7.2, but below 10.0.

14. The dispersion according to claim 1, wherein the aqueous dispersion has a maximum dynamic viscosity at a temperature of 25° C. in a shear rate range of from 0.001 to 0.25 reciprocal seconds of at least 1000 Pa's and below 5000 Pa·s.

15. A method for anti-corrosion pretreatment of a metal material selected from zinc, iron or aluminum or of a component which is composed at least partially of such metal materials, comprising steps of:

(i) diluting the aqueous dispersion of claim 1 by a factor of from 20 to 100,000;

(ii) activating the metal material or the component by contact with a colloidal aqueous solution comprising the diluted aqueous dispersion of (i);

(iii) then phosphating, optionally zinc phosphating, the metal material or the component.

16. The method according to claim 15, wherein the components are made at least partially of zinc and aluminum, and are pretreated in series, and the activating step (ii) is carried out by:

contact with the colloidal aqueous solution comprising the diluted aqueous dispersion of (i), wherein the total content of particulate inorganic compounds (a1) is composed at least partially of phosphates selected from the group consisting of hopeite, phosphophyllite, scholzite, hureaulite and combinations thereof; and the phosphating step (iii) is carried out by:

contact with an acidic aqueous composition containing 5-50 g/kg of phosphates dissolved in water, calculated as $PO_4$, 0.3-3 g/kg of zinc ions and an amount of free fluoride, measured per total acidic aqueous composition;

wherein a quotient of the concentration of the phosphates in the inorganic particulate constituent of the colloidal aqueous solution of the activating step (ii), in mmol/kg, based on $PO_4$; with respect to a sum of the amount of free fluoride and an amount of silicon in the acidic aqueous composition of the phosphating step, in each case in mmol/kg, is greater than 0.2.

* * * * *